US012753522B2

(12) United States Patent
Bulan

(10) Patent No.: US 12,753,522 B2
(45) Date of Patent: Oct. 6, 2026

(54) ELECTROLYSIS CELL, ELECTROLYZER AND METHOD FOR REDUCING $CO_2$

(71) Applicant: COVESTRO INTELLECTUAL PROPERTY GMBH & CO. KG, Leverkusen (DE)

(72) Inventor: Andreas Bulan, Langenfeld (DE)

(73) Assignee: Covestro Intellectual Property GmbH & Co. KG, Leverkusen (DE)

( * ) Notice: Subject to any disclaimer, the term of this patent is extended or adjusted under 35 U.S.C. 154(b) by 0 days.

(21) Appl. No.: 17/277,329

(22) PCT Filed: Sep. 6, 2019

(86) PCT No.: PCT/EP2019/073789
§ 371 (c)(1),
(2) Date: Mar. 18, 2021

(87) PCT Pub. No.: WO2020/057998
PCT Pub. Date: Mar. 26, 2020

(65) Prior Publication Data

US 2021/0348286 A1 Nov. 11, 2021

(30) Foreign Application Priority Data

Sep. 18, 2018 (EP) ..... 18195279

(51) Int. Cl.
*C25B 15/08* (2006.01)
*C25B 1/23* (2021.01)
(Continued)

(52) U.S. Cl.
CPC ..... *C25B 15/083* (2021.01); *C25B 1/23* (2021.01); *C25B 9/19* (2021.01); *C25B 9/65* (2021.01);
(Continued)

(58) Field of Classification Search
CPC .... C25B 1/23; C25B 3/26; C25B 9/19; C25B 9/23; C25B 9/77; C25B 15/08;
(Continued)

(56) References Cited

U.S. PATENT DOCUMENTS

2004/0007458 A1* 1/2004 Fujita ..... B23K 11/26 29/757
2005/0000798 A1* 1/2005 Faita ..... C25B 9/19 204/242
(Continued)

FOREIGN PATENT DOCUMENTS

CN 205329170 U 6/2016
DE 10159372 A1 * 6/2003 ..... C25B 15/08
(Continued)

OTHER PUBLICATIONS

International Preliminary Report on Patentability received for PCT Patent Application No. PCT/EP2019/073789, mailed on Apr. 1, 2021, 16 pages.
(Continued)

*Primary Examiner* — Ciel P Contreras
(74) *Attorney, Agent, or Firm* — K&L Gates LLP

(57) ABSTRACT

The invention relates to an electrolysis cell, an electrolyzer and to a method for the electrochemical reduction of carbon dioxide on an industrial scale.

18 Claims, 6 Drawing Sheets

Figure 1:
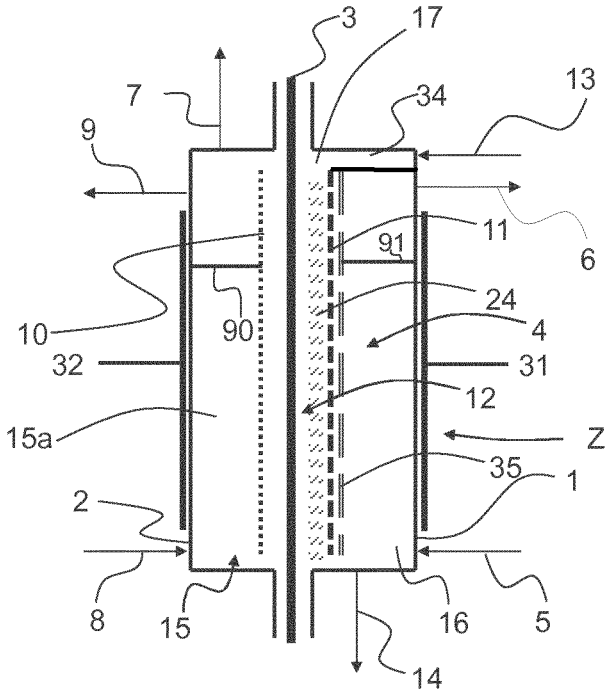

(51) Int. Cl.

| | |
|---|---|
| ***C25B 9/19*** | (2021.01) |
| ***C25B 9/65*** | (2021.01) |
| ***C25B 9/75*** | (2021.01) |
| ***C25B 9/77*** | (2021.01) |

(52) U.S. Cl.
CPC ..... *C25B 9/75* (2021.01); *C25B 9/77* (2021.01); *C25B 15/08* (2013.01); *C25B 15/087* (2021.01)

(58) Field of Classification Search
CPC ..... C25B 15/083; C25B 15/087; C25B 9/65; C25B 9/75
See application file for complete search history.

(56) References Cited

U.S. PATENT DOCUMENTS

| | | | | |
|---|---|---|---|---|
| 2016/0017503 | A1 | | 1/2016 | Kaczur et al. |
| 2018/0195184 | A1 | | 7/2018 | Fleischer et al. |
| 2019/0078222 | A1 | * | 3/2019 | Baldauf ..... C25B 3/25 |
| 2020/0308718 | A1 | * | 10/2020 | Patru ..... C25B 1/23 |

FOREIGN PATENT DOCUMENTS

| | | | | | |
|---|---|---|---|---|---|
| DE | 102005027735 | A1 | | 12/2006 | |
| WO | 03/42430 | A2 | | 5/2003 | |
| WO | WO-2015139129 | A1 | * | 9/2015 | ..... C25B 1/00 |
| WO | WO-2015184388 | A1 | * | 12/2015 | ..... C25B 1/02 |
| WO | 2018/001636 | A1 | | 1/2018 | |

OTHER PUBLICATIONS

International Search Report and Written Opinion received for PCT Patent Application No. PCT/EP19/073789, mailed on Nov. 20, 2019, 19 pages. (9 pages of English Translation and 10 pages of Original Document).

* cited by examiner

ELECTROLYSIS CELL, ELECTROLYZER AND METHOD FOR REDUCING $CO_2$

CROSS-REFERENCE TO RELATED APPLICATIONS

This application is a national stage application (under 35 U.S.C. § 371) of PCT/EP2019/073789, filed Sep. 6, 2019, which claims benefit of European Application No. 18195279.7, filed Sep. 18, 2018, both of which are incorporated herein by reference in their entirety.

The invention describes an electrolysis cell, an electrolyzer and a process for the electrochemical reduction of carbon dioxide on an industrial scale.

The production of basic chemicals, e.g. of carbon monoxide, methanol, ethane, propane, formaldehyde or synthesis gas, is at present carried out on the basis of fossil raw materials. Owing to the increasing shortage of such raw materials and the $CO_2$ emissions associated therewith, it is necessary to have sustainable methods of synthesis in order to conserve fossil resources such as natural gas or petroleum and to avoid the emission of $CO_2$ at the latest after the utilization as material at the end of the life cycle of the products produced from the basic chemicals by combustion of $CO_2$ liberated and the global warming resulting therefrom.

Furthermore, it is helpful to use $CO_2$ as raw material for the synthesis. This avoids the liberation of $CO_2$ from various processes, for example steel production or incineration of domestic waste. The increase in global warming could be slowed thereby.

The use of renewably produced energy, e.g. from wind energy, water power or solar power stations, especially in combination with utilization of $CO_2$ as raw material, makes the new process a particularly sustainable process.

Thus, electrolysis processes would be particularly suitable for producing the abovementioned basic chemicals in a sustainable way.

Since the basic chemicals are typically produced on an at least 1000 metric ton scale, the electrolysis processes utilizing $CO_2$ would have to be made available with a large scale. In order to produce industrial amounts of products using electrolysis processes, large-area electrolysis cells and electrolyzers having a large number of electrolysis cells are necessary. Here, industrial production amounts are quantities of more than 0.1 kg of $CO_2/(h*m^2)$ per electrolysis cell. For this purpose, electrolysis cells having an electrode area of more than 2 $m^2$ per electrolysis cell are normally used, as is known, for example, from chloralkali electrolysis. The electrolysis cells are placed together in groups of up to 100 cells in a rack. A plurality of racks then form an electrolyzer. The electrochemical reaction of $CO_2$ in an electrolysis cell preferably occurs at a gas diffusion electrode which is connected as cathode and can in principle be carried out according to the reaction indicated below by way of illustration:

$$CO_2+H_2O+2e^- \rightarrow CO+2\ OH^-$$

Here, the $CO_2$ is converted into CO and hydroxide ions, with hydrogen also being able to be produced in a secondary reaction.

It is common to all known processes that a gas diffusion electrode is used for the electrochemical reaction and a cell construction on an industrial scale, in which the gas diffusion electrode can be installed and operated, has to be available for operation of the gas diffusion electrode.

Industrial electrolyzers as are used, for example, in chloralkali electrolysis usually have an electrode area of more than 1 $m^2$ per electrolysis cell. More than 100 electrolysis cells are connected together to form an electrolyzer. A number of electrolyzers are then used for production on a site.

The operation of gas diffusion electrodes requires particular measures in industrial electrolysis apparatuses.

Thus, care has to be taken in the industrial use of gas diffusion cathodes to ensure that the gas diffusion electrode (hereinafter also referred to as GDE for short) used for this purpose has an open-PORED structure and is installed between electrolyte space and gas space. The internal structure of the GDE has to make it possible for the reaction of the gas to occur at the three-phase boundary between electrolyte, catalyst and gas as close as possible to the electrolyte. This boundary layer is stabilized by the hydrophobicity of the GDE material. However, it is found that this stabilization, which is brought about by the surface tension of the electrolyte at the electrode surface, permits only a finite pressure gradient between gas side and liquid side of the GDE. If the gas-side pressure is too high, the gas finally breaks through the GDE and the function of the GDE is destroyed in this region, i.e. the electrolysis process is locally interrupted here. On the other hand, if the liquid pressure is too high, the three-phase boundary is shifted out of the catalyst region of the GDE until the GDE is flooded with electrolyte and a further pressure increase leads to liquid breakthrough of electrolyte into the gas space. As a result, the function of the GDE is likewise destroyed and the desired reaction does not take place.

In the case of a vertical electrode arrangement, as is usefully employed in industrial electrolyzers, this leads to a limitation of the construction height of the electrolysis cell due to the inability of gas diffusion electrodes to be operated at an excessively high gas pressure or liquid pressure. A typical industrial construction height for the electrode of an electrolysis cell is more than 30 cm, usually from about 100 to 150 cm. In the case of a membrane electrolysis having a construction height of more than 10 cm, gas would already get from the gas space into the cathode-electrolyte gap between GDE and membrane in the upper region of the electrolysis cell. The industrially achievable construction height therefore remained restricted to about 20-30 cm, which would not allow industrially economical utilization for the electrolyzers currently on the market.

Cell concepts for the industrial scale for industrial electrochemical reduction of $CO_2$ have not yet been described and made available. First experiments were always carried out only on a small laboratory cell scale, with the construction height being less than 10 cm and the problem of the construction height and the pressure differences between the gas space and the electrolyte space therefore not yet playing any role.

It was therefore an object of the present invention to provide an apparatus and a process for operating a gas diffusion electrode on an industrial scale, in which $CO_2$ is converted at the GDE. For the present purposes, an industrial scale constitutes production amounts at which more than 0.1 kg of $CO_2/h*m^2$ are reacted electrochemically.

The electrochemical reduction of $CO_2$ to form CO or $CO/H_2$ mixtures differs fundamentally from the electrochemical reduction of $O_2$ at gas diffusion electrodes known in principle from chloralkali membrane electrolysis. In the reduction of $O_2$, hydroxide ions are formed from oxygen gas, so that a reduction in volume takes place. The GDE consumes the oxygen, as a result of which there is a decrease in the partial pressure. However, the reduction of $CO_2$ to form $CO/H_2$ forms the equimolar amount of gaseous product (CO or $CO/H_2$) from the $CO_2$ gas, so that no decrease in the partial pressure takes place. This requires a specific mode of operation, in particular on the cathode side of the electrolysis cell.

As mentioned above, there have hitherto not been any known industrial electrolysis processes and apparatuses by means of which industrial amounts of CO can be produced from $CO_2$.

The above-described technical object is achieved according to the invention by an electrolysis cell for the electrochemical reaction of $CO_2$ on an industrial scale, comprising at least a cathode half shell having a cathode, having a gas space connected to a first gas feed conduit for carbon dioxide gas and to a first gas discharge conduit for gaseous reaction products, in particular carbon monoxide, hydrogen and unreacted carbon dioxide gas, and having a catholyte inlet and a catholyte outlet, and further comprising an anode half shell having an anode and a separator arranged between anode half shell and cathode half shell for separating anode space and cathode space, where the anode half shell is provided with at least a second gas discharge conduit for the anode reaction product, in particular oxygen and possibly carbon dioxide, an anolyte inlet and an anolyte outlet and also an anode, and further comprising electric power leads for connecting the anode and electric power leads for connecting the cathode to a DC voltage source, characterized in that the cathode is configured as gas diffusion electrode for reacting carbon dioxide gas and cathode, anode and the separator are arranged vertically in their main extension and a gap for passage of the catholyte according to the principle of a falling liquid film is arranged between separator and cathode.

In a preferred embodiment of the invention, the separator is an ion exchange membrane or a diaphragm, with the separator particularly preferably being an ion exchange membrane.

Suitable ion exchange membranes are, in particular, membranes which are configured as cation exchange membranes and can conduct cations from the anode space into the cathode space. These are known in principle from the prior art. As an alternative, it is in principle also possible to use anion exchange membranes which transport anions from the cathode space into the anode space. Preference is given to using cation exchange membranes. In conventional ion exchange membranes, ion transport is also associated with water transport which depends on the selected concentrations of the anolyte and catholyte, temperature and operating conditions.

Suitable diaphragms are, in particular, all diaphragms which are known in principle for separating the anode space from the cathode space, especially from the cathode gap, in a gastight manner. Here, the diaphragm should have, in particular, a gastightness (bubble point) of more than 10 mbar, preferably more than 300 mbar, particularly preferably more than 1000 mbar. In particular, the diaphragm should also be inert toward the electrolyte and the reaction gases and be stable at the operating temperatures. Diaphragms for electrolysis are known in principle from the prior art.

The electrolysis cell is intended for electrolysis on an industrial scale, which means, in particular, that the construction height of the electrolysis cell is at least 30 cm and thus differs significantly from laboratory and experimental cells.

The main consequence is that at such a construction height, it is necessary to undertake measures for preventing passage of both catholyte and gas through the gas diffusion electrode.

In a preferred embodiment, the vertical main extension of the cathode is thus at least 30 cm, preferably at least 60 cm, particularly preferably at least 100 cm. Such a construction height is made possible by operation of the electrolysis cell according to the principle of a falling liquid film (catholyte) in the cathode space, without permeation of catholyte or permeation of gas through the gas diffusion electrode occurring.

As cathode, particular preference is given to using a gas diffusion electrode which contains an electrocatalyst for $CO_2$ reduction which is, in particular, produced on the basis of silver and/or silver oxide, preferably on the basis of silver particles as electrocatalyst, and has been applied compacted together with a pulverulent fluoropolymer, in particular PTFE powder, as nonconductive binder to a metallic or nonmetallic, conductive or nonconductive support. Preference is given to using a metallic, conductive support for compacting.

Instead of pulverulent fluoropolymers, it is in principle also possible to employ other polymer powders having comparable properties (i.e., in particular, inert toward electrolyte at reaction temperature and high current density and processable in the production of the GDE), in particular polyalkylenes, particularly preferably polyethylene, polypropylene or partially fluorinated polymers.

In another preferred embodiment of the novel electrolysis cell, a means for slowing the catholyte flow, hereinafter referred to as a flow brake, is provided in the gap between membrane and GDE. In this way, the residence time of the catholyte in the gap in front of the cathode can be controlled. The flow brake is particularly preferably configured as electrically nonconductive, inert sheet-like textile structure.

The flow brake can, in particular, consist of a porous sheet-like textile structure, particularly preferably a woven fabric, drawn-loop knitted fabric or formed-loop knitted fabric, which is arranged in the gap. As an alternative, mechanical internals in the gap, which allow horizontal electrolyte flow or electrolyte flow slightly angled relative to the horizontal so that the electrolyte flows in a meandering fashion are also conceivable. The material of which the flow brake is made can in principle be hydrophilic, as in the case of, for example, the flow brake known from WO2003042430A2, example 1, or hydrophobic depending on the choice of the flow conditions or the viscosity of the catholyte. Preferred materials have been described above.

To ensure that the gap is always sufficiently supplied with electrolyte, the introduction of the catholyte can preferably be effected by a distributor channel which connects the catholyte feed conduit to the gap. To ensure that the distributor channel is always filled with electrolyte, it can have an overflow (not shown in the figures) via which any excess electrolyte supplied can be discharged.

The gas diffusion electrode here seals, in particular, the distributed channel and the gap from the gas space.

Contacting of the gas diffusion electrode (GDE) with the power lead in the cathode space is advantageously and preferably effected via an elastically mounted electrically conductive structure. This can be configured so that a stiff structure, e.g. in the form of expanded metal, mounted on springs electrically contacts the GDE from the side of the gas space. To maintain the dimensions of the gap between GDE and separator under a compressive load, e.g. due to the electric contacting, spacers, in particular, are installed in the gap between separator and GDE. The function of the spacer can also be performed by the flow brake when this has sufficient mechanical stability and stiffness under a compressive load on its surface.

In a preferred embodiment of the novel electrolysis cell, the second gas discharge conduit for the anode reaction product is connected at the upper end of the anode space, the first gas discharge conduit for gaseous reaction products, in particular for carbon monoxide, hydrogen and unreacted carbon dioxide gas, is connected at the upper end of the gas space and the gas feed conduit for carbon dioxide is connected at the lower end of the gas space. Introduction of the carbon dioxide can preferably be effected via a gas distributor channel, e.g. a pipe having a plurality of holes as gas inlets, located within the electrolysis cell, so that the electrode surface can be supplied with carbon dioxide and the reaction products can be discharged uniformly over the width of the electrolysis cell.

The amount of $CO_2$ supplied to the cathode half shell is at least 0.5 times the amount of charge flowing as per the electric current, calculated according to the above reaction equation. Substoichiometric amounts of $CO_2$ are required when more hydrogen is deliberately to be produced. When the production of hydrogen is to be avoided, $CO_2$ is introduced in excess. Here, the amount of $CO_2$ is preferably a multiple of the stoichiometric amount required according to the electric current which flows. In particular, from 0.5% to 800% more $CO_2$ than stoichiometrically required are introduced.

In a further preferred variant of the novel electrolysis cell, the second gas discharge conduit is connected to a separation device for separating carbon dioxide from oxygen and the separation device is connected via a carbon dioxide conduit to the gas feed conduit in order to be able to recirculate carbon dioxide which has been separated off to the electrolysis cell. The oxygen which has been separated off can, owing to its purity, be passed directly to further use for other chemical reactions.

In a preferred embodiment of the electrolysis cell for the reduction of $CO_2$ to CO, an aqueous solution of alkali metal hydrogencarbonate, preferably potassium hydrogencarbonate, cesium hydrogencarbonate or sodium hydrogencarbonate, particularly preferably potassium hydrogencarbonate, is used as catholyte.

Independently thereof, an aqueous solution of alkali metal hydrogencarbonate, preferably potassium hydrogencarbonate, cesium hydrogencarbonate or sodium hydrogencarbonate, particularly preferably potassium hydrogencarbonate, is used as anolyte in a further preferred embodiment of the electrolysis cell. The salts in anolyte and catholyte advantageously have, in particular, the same cations.

To increase the conductivity, electrolyte salts, preferably having the same cations, which are inert in respect of the anode reaction or the cathode reaction, e.g. alkali metal sulfates or alkali metal hydrogensulfates, in particular selected from among potassium, cesium and sodium sulfate or hydrogensulfate, particularly preferably potassium hydrogensulfate, can be added independently both to the anolyte and to the catholyte. The total concentration of the salt is preferably from 0.1 to 2 mol per 1, with particular preference being given to using electrolytes having a conductivity at 25° C. of greater than 10 S/m (S is siemens and m is meter).

In a particularly preferred variant of the novel electrolysis cell, when the same electrolyte salt is used for anolyte and catholyte, the catholyte outlet is installed at the lower end of the gap and the catholyte inlet is installed above the gap on the cathode half shell and the catholyte outlet is connected to a catholyte collection pipe in which catholyte from the catholyte outlets of the electrolysis cells is combined. The anolyte from the anolyte outlet of the electrolysis cells is combined in a collection tube for anolyte (see, for example, FIG. 1).

Preference is consequently given to an electrolysis cell which is characterized in that, when the same electrolyte salt is used by anolyte and catholyte, the catholyte outlet is installed at the lower end of the gap and the catholyte inlet is located above the gap on the cathode half shell and the catholyte outlet is, in the case of a plurality of catholyte outlets from more, preferably via one collection tube conduit, connected to an electrolyte collection facility in which catholyte from the catholyte outlet and anolyte from the anolyte outlet are combined. In the case of a plurality of anolyte outlets, a collector is also particularly preferably installed between anolyte outlet and electrolyte collection facility.

Before the catholyte and the anolyte are combined with one another, the two solutions are preferably each fed to a gas removal unit. Here, gas dissolved in and dispersed in the electrolyte is separated off. The anolyte is thus substantially free of oxygen, and the catholyte of carbon monoxide and hydrogen. This prevents anolyte comprising $CO_2$-containing oxygen being mixed with catholyte comprising $CO/H_2$-containing gas and explosive gas mixtures being formed. The electrolytes anolyte and catholyte which have been freed of gases can then be combined.

To set the prescribed inflow temperatures of the electrolytes into the anode space and cathode space, the electrolyte can if required be heated or else cooled by means of heat exchangers. To set, if necessary, the concentration of the electrolyte, appropriate amounts of electrolyte salt or water can be added. Likewise, more concentrated or more dilute electrolyte solutions can be introduced into the electrolysis cell in order to set the desired inlet concentration.

In a further preferred embodiment of the novel electrolysis cell, the first gas discharge conduit is connected, in particular via a collection conduit which connects the first gas discharge conduit of the electrolysis cell to further similar gas discharge conduits of other electrolysis cells, to a gas separation unit for separating carbon monoxide, hydrogen and unreacted carbon dioxide gas.

In this specific embodiment of the novel cell, the gas separation unit preferably has a recirculation conduit for carbon dioxide gas separated off, which recirculation conduit is connected to the first gas feed conduit for carbon dioxide gas and the gas space. In particular, a distributor tube conduit is interconnected which connects the recirculation conduit to the first gas feed conduit for carbon dioxide gas of the electrolysis cell and to further similar first gas feed conduits of other electrolysis cells.

The gas separation unit also preferably has a discharge conduit for carbon monoxide separated off, which discharge conduit is connected to a chemical production plant for the chemical conversion of carbon monoxide into chemical intermediates. As an alternative, the carbon monoxide which has been separated off can be fed to a collection conduit or to a store for further use.

Typical intermediates are, for example, phosgene, isocyanates or bisphenols for the production of industrial polymers, in particular polyurethanes or polycarbonates.

The gas separation unit also preferably has a discharge conduit for hydrogen which has been separated off, which discharge conduit is in turn connected to a hydrogen pipe network or a dispensing facility for hydrogen.

In a preferred embodiment of the invention, the second gas discharge conduit for the anode reaction product is connected to a second gas separation unit for separating carbon dioxide from oxygen and the second gas separation unit is connected via a carbon dioxide conduit, and optionally via a distributor tube conduit, to the gas feed conduit.

In a further particularly preferred variant (see, for example, FIG. 2) of the electrolysis cell, the second gas discharge conduit for the anode reaction product and the anolyte discharge conduit form one unit and are connected to a gas/liquid separation of an external collection tube conduit. The gas/liquid separation separates the gas mixture composed of $CO_2$ and $O_2$ from the electrolyte. The anolyte is fed to the second gas removal unit and the gas to the second gas separation unit for $CO_2$ and $O_2$. The electrolyte from the electrolyte collection facility is then fed back into the anolyte inlet via the external distributor tube conduit for anolyte.

In a further particularly preferred variant of the electrolysis cell, the electrolyte recirculation conduit (for catholyte and/or anolyte as appropriate) has a feed conduit for mixing in optionally water or more highly concentrated electrolyte and a mixing unit for mixing the depleted electrolyte (e.g. the anolyte) with more highly concentrated electrolyte or, depending on requirements, mixing in water or low-concentration electrolyte.

Nickel and nickel alloys have been found to be preferred materials for construction of the cathode half shell. However, in a particularly preferred embodiment of the electrolysis cell all parts which are in contact with electrolyte in the electrolysis cell consist of nickel and have a start-up corrosion protection layer of gold. It is also conceivable in principle to use polymers which are inert at an operating temperature below 90° C. as alternative construction materials or material for the interior coating of the cathode side of the cell, as long as these are chemically resistant to the electrolytes and gases at the given temperature.

As preferred material for the construction of the anode half shell, use is made of nickel and nickel alloys, titanium or titanium alloys. All parts which are in contact with electrolyte in the electrolysis cells can also particularly preferably have a start-up corrosion protection layer of gold in the region of the anode half shell. Here too, inert polymers having a sufficient heat resistance and mechanical strength can likewise alternatively be used as construction materials or material for the interior coating of the anode side of the electrolysis cell.

The invention further provides an electrolyzer for the electrochemical reaction of $CO_2$ on an industrial scale by the membrane electrolysis process or diaphragm electrolysis process, characterized in that the electrolyzer has a plurality of electrolysis cells according to the invention, which cells are electrically connected to one another in a bipolar manner.

The electrolyzer is particularly preferably configured in such a way that the individual electrolysis cells are connected to one another in a bipolar manner and the end elements are provided with power inlet plates or power outlet plates.

The connections of the anolyte and catholyte feed conduits and the corresponding electrolyte discharge conduits of the individual electrolysis cells are preferably connected to one another via external connecting tube conduits with distributors or collectors. A further preferred embodiment of the novel electrolyzer is characterized in that a collector for anolyte, a collector for catholyte, a distributor for anolyte, a distributor for catholyte and a gas distributor for reaction gas and a gas collector for product gases are provided to connect the feed conduits and discharge conduits of the various electrolysis cells. The feed conduits of at least 10 electrolysis cells are, in particular, connected in a distributor and the discharge conduits of at least 4 electrolysis cells are, in particular, connected in a collector. The introduction of anolyte is thus effected (see, for example, FIG. 2) via a distributor tube conduit for the anolyte. From these distributor tube conduits, the anolyte is fed via an, in particular flexible, connection, e.g. a piece of flexible tubing, to the elements connected thereto into the anode space in each case. The anolyte conveyed out of the anode space and the gas produced therein (main constituent oxygen and carbon dioxide) is again fed into a collection tube conduit. This outer collection tube conduit can function as a gas/liquid separator, so that gas can be fed via a further separate conduit to an optional second gas separation unit for separation of oxygen and carbon dioxide. From the connecting tube conduit, the anolyte is fed to the second gas separation unit and then to the electrolyte collection facility.

The introduction of the catholyte is, in particular, effected via an external distributor tube conduit. From this exterior distributor tube conduit, the catholyte is fed via an, in particular flexible, connection, e.g. a piece of flexible tubing, to the electrolysis cells connected thereto and at these to, in particular, the interior distributor channel of the cathode in each case. The catholyte running out of the gap is again fed to an external collection tube conduit via the outlet. To prevent gas getting from the cathode space into the external collection tube conduit via the outlet, the outlet is, in particular, configured so that it dips into electrolyte which is present in the collection tube conduit and thus forms a seal.

The introduction of the gas into the cathode space (see, for example, FIG. 5) is preferably effected via an external distributor tube conduit. From this exterior distributor tube conduit, the gas is fed via a connection to the cathodes joined thereto via the gas feed conduit. The connection of the cathode half shell to the distributor tube conduit can, for example, be effected via a flexible piece of tubing. Within the electrolysis cell, the gas can, in a particularly preferred embodiment, be distributed via a distributor system over the width of the electrolysis cell, so that uniform flow of the gas from the bottom upward occurs and the GDE can be supplied with a sufficient amount of carbon dioxide gas. In order to feed the gas in the gas space to the GDE, internals which bring about swirling of the gas flow can be installed in the gas space. Likewise, this ensures that the reaction products and excess unreacted carbon dioxide gas is discharged again from the electrolysis cell. The gas from the gas space goes via the outlet into an exterior collection tube conduit again. The connection between cathode outlet and collection tube conduit can once again be via a piece of flexible tubing. The gas from the outer collection tube conduit is fed to a gas separation facility for separation of CO, $H_2$ and unreacted $CO_2$. $CO_2$ gas which has been separated off in the gas separation device is fed together with fresh carbon dioxide gas via the exterior distributor tube conduit back into the cathode space.

The novel electrolysis cells are preferably operated at an absolute pressure in the range from 900 mbar (900 hPa) to 2000 mbar (2000 hPa).

As gas diffusion electrode for the reduction of $CO_2$ to CO, particular preference is given to using a silver-based GDE. In particular, a silver-based GDE which is produced according to the measures which are disclosed in principle in EP-A 1728896, particularly preferably as in the examples described therein, is preferably used. The porosity of the catalytically active layer, calculated from the amounts and the material densities of the raw materials used divided by the volume of the electrode calculated from the geometric dimensions of area and thickness minus the support volume should particularly preferably be more than 10% but, in particular, less than 80%.

To avoid undesirable buoyancy effects caused by the light product gases CO and hydrogen, carbon dioxide is preferably fed into the gas space so as to produce a gas velocity close to the rear side of the gas diffusion electrode of from 0.001 to 15 m/s, preferably from 0.01 to 10 m/s. The gas velocity is calculated from the volume flow of the introduced gas or gas mixture and the area given by the distance from the GDE to the separator multiplied by the gap width. In the case of adjustment of the amount of gas, care would have to be taken to ensure that the amount does not go below at least 0.5 times the stoichiometrically required amount of $CO_2$ calculated according to the electric current flowing and the resulting quantity of charge.

The gas velocity is preferably kept in the above-defined range from 0.001 to 15 m/s, preferably from 0.01 to 10 m/s, by structural means. This can, for example, be brought about by the gas space in the region between gas diffusion electrode and support structure for the gas diffusion electrode being kept as narrow as possible. In the case of industrial electrolysis cells, the distance from the gas diffusion electrode to the rear wall of the cathode should therefore be not more than 5 cm, preferably not more than 4 cm, particularly preferably not more than 2 cm. Flow-directing internals in the region between gas diffusion electrode and support structure for the gas diffusion electrode in order to prevent undesirable chimney effects are also conceivable. Furthermore, internals which make the gas flow turbulent in the region between gas diffusion electrode and support structure are also possible. This can be brought about by, for example, installation of porous structures such as metal or polymer foams or knitted, braids or woven fabrics.

As support for manufacture of the GDE, preference is given to using gilded nickel meshes, silver meshes, PTFE-coated glass fiber supports, carbon fiber woven fabrics or C-based knitted fabrics/structures and also supports based on polymers, e.g. polypropylene or polyethylene.

The separation of anode chamber and cathode chamber by means of the separator serves to avoid mixing of the electrolytes and to avoid an electrochemical short circuit. In the absence of the separator, the anodically formed gas could be reduced further at the cathode, as a result of which an electrochemical short circuit would be formed, the current yield would be reduced and the economics of the process would be impaired. Furthermore, the hydrogen and/or carbon monoxide formed at the GDE could form explosive gas mixtures with the anodically formed oxygen.

If, according to a preferred embodiment of the electrolysis cell, an ion exchange membrane is used as separator, preference is given to using cation exchange membranes which are known in principle, for example fumasep F 1075-PK (manufacturer: Fumatech GmbH) of the type Nafion N 324 (manufacturer: Chemours Company), in particular Nafion N324.

If, according to a preferred embodiment of the electrolysis cell, a diaphragm is used as separator, it is possible to use diaphragms which are known in principle for the electrolysis; for example, the diaphragm of the type Zirfon™ Pearl (manufacturer: Agfa) made up of a PTFE and zirconium oxide is used in particular.

The electrolysis cell is advantageously constructed, in particular, so that the separator rests directly on the anode. The anode is electrically conductively connected to the anode half shell. The anode is preferably configured so that it has hollow spaces which are shaped so that the gas formed at the anode (e.g. oxygen gas) is conducted to the rear side of the anode facing away from the separator. As anode structure, it is possible to use, for example, either an expanded metal or other anode structures known in principle from the prior art. A preferred design of the novel electrolysis cell is furthermore characterized in that the anode rests on the separator with point-, line- or area-shaped contact positions of the anode. This makes it possible to conduct the gases which are evolved at the anode to the rear side of the anode facing away from the separator. Gas which is present between anode and separator may cause an increased electrolysis voltage which impairs the electrolysis process or the economics of the electrolysis process. Furthermore, damage to the separator during operation is avoided by the separator resting on the anode. The evolution of gas can lead to pressure fluctuations as a result of which the separator is moved back and forth during the electrolysis, which in the long term causes mechanical damage with the consequence of a crack and thus a lack of gas/liquid separating effect.

The differential pressure with which the separator is pressed onto the anode is at least 10 mbar in such a preferred embodiment of the invention.

The invention further provides a process for the electrochemical reaction of $CO_2$ on an industrial scale by the membrane electrolysis process at a gas diffusion electrode as cathode, characterized in that the process is carried out in the novel above-described electrolysis cell, where the separator is an ion exchange membrane, which comprises the steps:

- introduction of the catholyte, an aqueous solution containing at least alkali metal hydrogencarbonate, via the catholyte inlet into the gap between ion exchange membrane and cathode,
- introduction of the anolyte, an aqueous solution containing at least alkali metal hydrogencarbonate, via the anolyte inlet into the anode space,
- introduction of the carbon dioxide gas stream through the first gas feed conduit into the gas space,
- setting of the electrolysis voltage at the power leads,
- discharge of the reacted catholyte at the catholyte outlet,
- discharge of the anode reaction product consisting of anolyte and product gas, with anolyte being discharged through the anolyte outlet and product gas oxygen and possibly $CO_2$ being discharged through the second gas discharge conduit or anolyte and product gas being, in particular, discharged together via a conduit,
- discharge of the gaseous cathode reaction product consisting of at least CO, unreacted $CO_2$ and possibly hydrogen via the first gas discharge conduit from the gas space,
- separation of the gas mixture of CO, unreacted $CO_2$ and possibly hydrogen into the components and recirculation of the unreacted $CO_2$ into the first gas feed conduit,
- setting of the initial concentration of alkali metal hydrogencarbonate in the discharged anolyte and catholyte, and
- recirculation of the catholyte to the catholyte inlet and recirculation of the anolyte to the anolyte inlet.

The invention further provides a process for the electrochemical reaction of $CO_2$ on an industrial scale by the diaphragm electrolysis process at a gas diffusion electrode as cathode, characterized in that the process is carried out in the novel above-described electrolysis cell, where the separator is a diaphragm, which comprises the steps:

introduction of the catholyte, an aqueous solution containing at least alkali metal hydrogencarbonate, via the catholyte inlet into the gap between diaphragm and cathode, introduction of the anolyte, an aqueous solution containing at least alkali metal hydrogencarbonate, via the anolyte inlet into the anode space, introduction of the carbon dioxide gas stream through the first gas feed conduit into the gas space, setting of the electrolysis voltage at the power leads and, discharge of the reacted catholyte at the catholyte outlet, discharge of the anode reaction product consisting of anolyte and product gas, with anolyte being discharged through the anolyte outlet and product gas oxygen and possibly $CO_2$ being discharged through the second gas discharge conduit or anolyte and product gas being, in particular, discharged together via a conduit, discharge of the gaseous cathode reaction product consisting of at least CO, unreacted $CO_2$ and possibly hydrogen via the first gas discharge conduit from the gas space, separation of the gas mixture of CO, unreacted $CO_2$ and possibly hydrogen into the components and recirculation of the unreacted $CO_2$ into the first gas feed conduit, setting of the initial concentration of alkali metal hydrogencarbonate in the discharged anolyte and catholyte, and recirculation of the catholyte to the catholyte inlet and recirculation of the anolyte to the anolyte inlet.

In a preferred embodiment of the abovementioned process, the carbon dioxide gas is humidified with water vapor before it is fed into the electrolysis cell and into the gas space. Here, the carbon dioxide gas is loaded with such an amount of water that the water vapor partial pressure of the catholyte in the cell corresponds to that of the water vapor partial pressure of the carbon dioxide gas fed in. This makes it possible to prevent water from being added to the electrolyte in the interior of the gas diffusion electrode at the phase boundary and water being withdrawn. It may be necessary to heat the carbon dioxide gas fed in so that a sufficient amount of water can be taken up by the carbon dioxide.

The two novel processes (membrane electrolysis and diaphragm electrolysis) are preferably carried out so that the gas velocity in the gas space close to the rear side of the gas diffusion electrode is from 0.001 m/s to 15 m/s, preferably from 0.01 m/s to 10 m/s.

In a further preferred embodiment, the two novel processes (membrane electrolysis and diaphragm electrolysis) are carried out so that the drift speed at which the catholyte flows through the gap from the top downward is from 0.2 cm/s to 15 cm/s, preferably from 1 cm/s to 10 cm/s. Independently thereof, the volume flow of the anolyte in the anode half shell is set to a value of from 10 $l/(h*m^2)$ to 300 $l/(h*m^2)$ (here, the units l=liters of anolyte, h is hour and $m^2$ is the area of the anode in $m^2$).

The invention will be illustrated by way of example below with the aid of the figures.

The figures show:

FIG. 1 a schematic vertical cross section through an electrolysis cell Z

Figure 2:
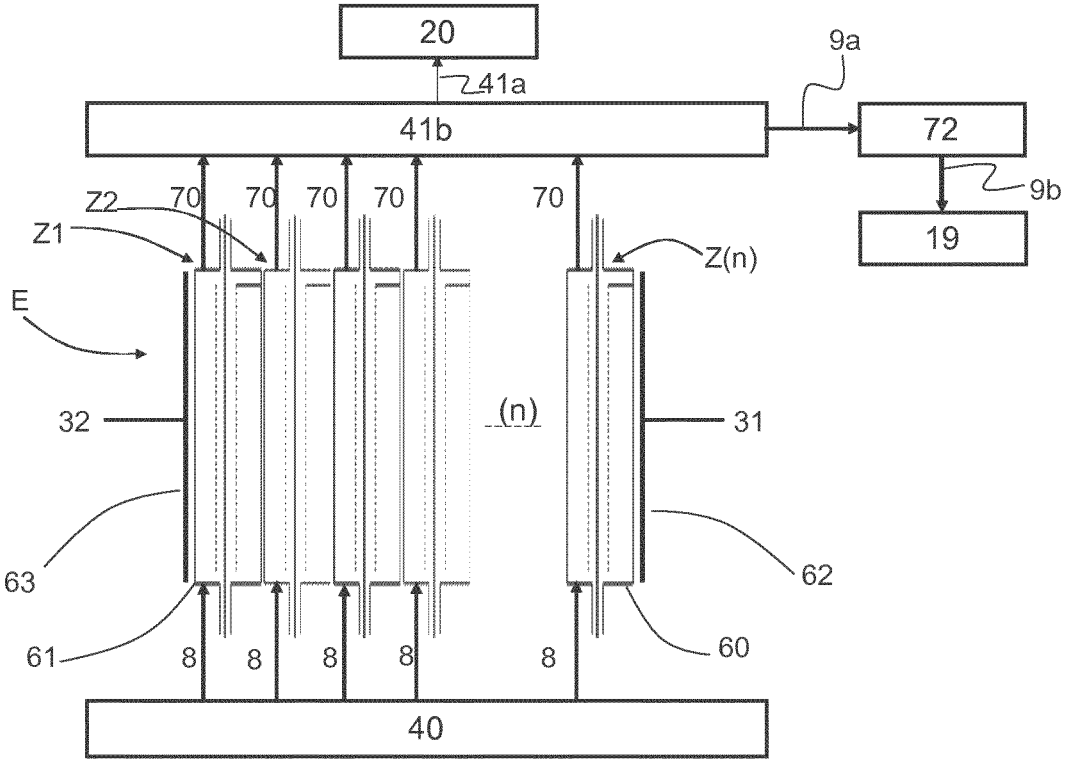
Figure 3:
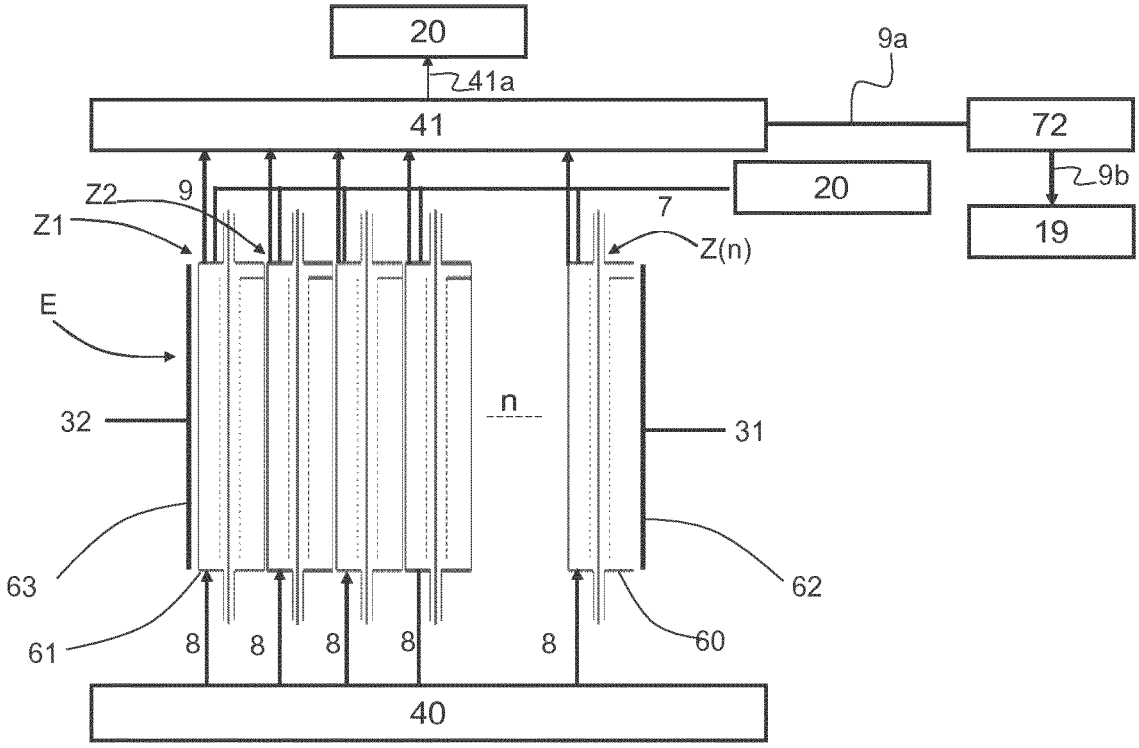
Figure 4:
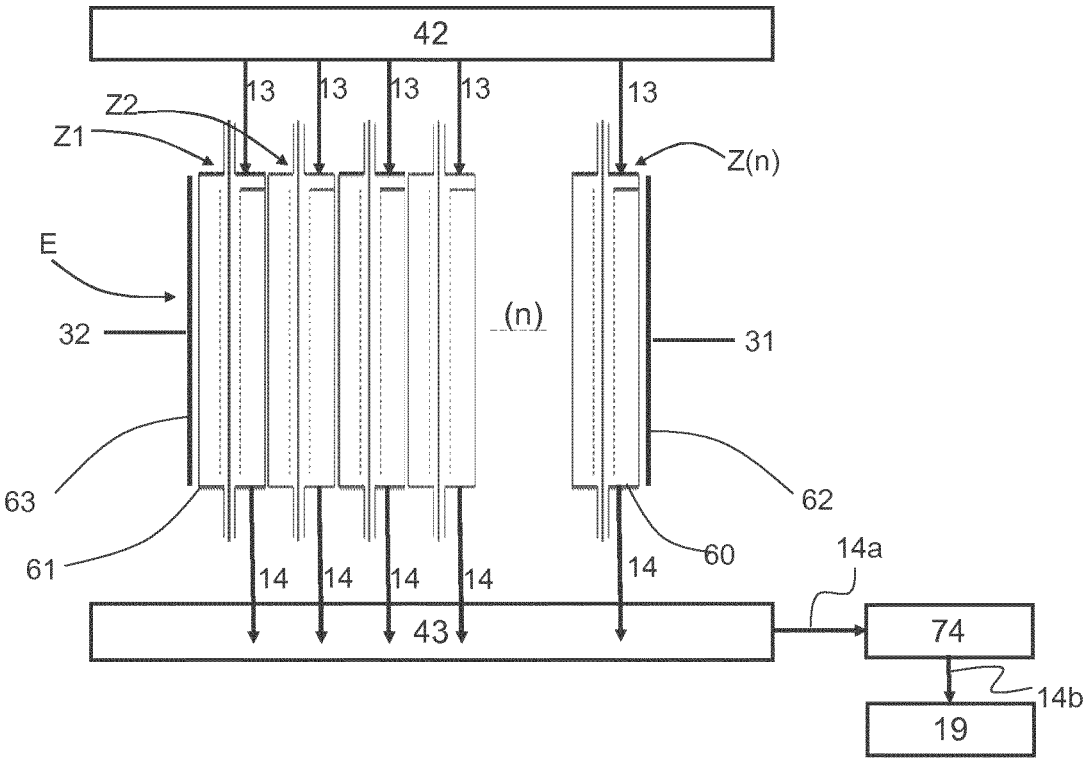
Figure 5:
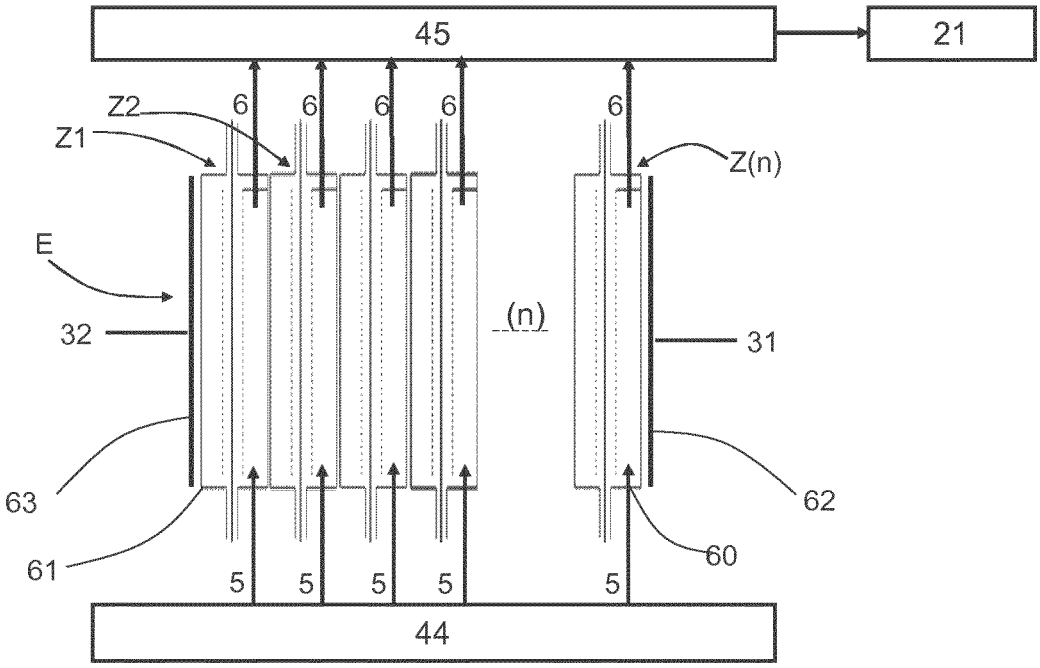
Figure 6:
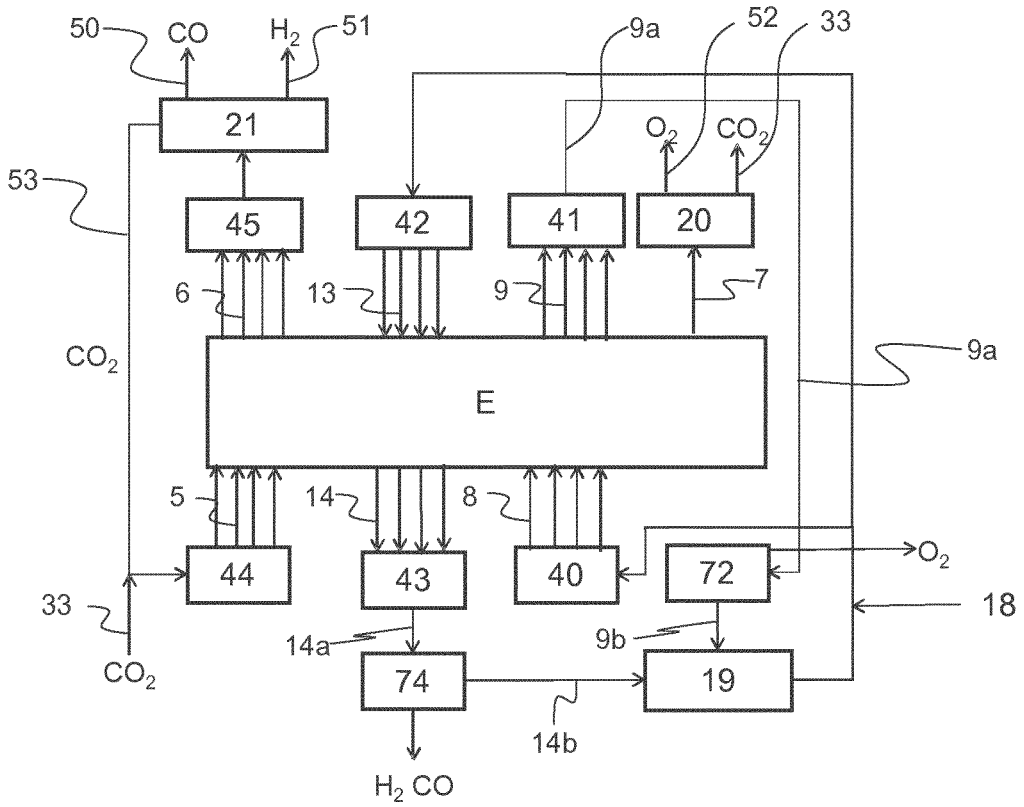

FIG. 2 the introduction and discharge of anolyte with joint outlet of a plurality of electrolysis cells FIG. 3 the introduction and discharge of anolyte with separate outlets of a plurality of electrolysis cells FIG. 4 the introduction and discharge of catholyte from a plurality of electrolysis cells FIG. 5 the introduction and discharge of gas at the cathode FIG. 6 a schematic overview of the entire process In the figures, the reference symbols have the following meanings:

1 Cathode half shell
2 Anode half shell
3 Separator (diaphragm, ion exchange membrane)
4 Gas space (cathode)
5 First gas feed conduit for carbon dioxide (cathode space)
6 First gas discharge conduit for gaseous reaction products (cathode space)
7 Second gas discharge conduit for the anode reaction product (anode space)
8 Anolyte inlet
9 Anolyte outlet
**9*a*** Oxygen-containing anolyte outflow to gas removal unit
**9*b*** Oxygen-free anolyte outflow
10 Anode
11 Cathode (GDE)
12 Catholyte gap
13 Catholyte inlet
14 Catholyte outlet
**14*a* $CO/H_2$-containing catholyte outflow from the collection facility 43** to the gas removal unit
74
**14*b*** $CO/H_2$-free catholyte outflow
15 Anode space
**15*a*** Anolyte
16 Cathode space
17 Catholyte
18 Feed conduit for water or concentrated or dilute electrolyte for setting of the concentration
19 Electrolyte collection facility
20 Second gas separation unit for $CO_2/O_2$ separation
Gas separation unit for $CO/H_2/CO_2$
24 Flow brake
31 Power lead for cathode
32 Power lead for anode
33 Carbon dioxide gas
34 Distributor channel
35 Elastic structure
40 Exterior distributor tube conduit for anolyte inlets 8
41 Exterior collection tube conduit for anolyte outlets 9
**41*a*** Gas discharge channel for $O_2/CO_2$
**41*b* Exterior collection tube conduit for combined anolyte and gas discharge conduits 70**
(discharge of gas and electrolyte) with gas/liquid separation
42 Exterior distributor tube conduit for catholyte inlets 13
43 Exterior collection tube conduit for catholyte outlets 14
44 Exterior distributor tube conduit for gas feed conduit 5 to cathode
45 Exterior collection tube conduit for first gas discharge conduit 6 from the cathode
50 CO gas
51 $H_2$ gas
52 $O_2$ gas
53 $CO_2$ gas recirculation conduit
60 Power supply to end electrolysis cell
61 Power outlet from end electrolysis cell
62 Power supply plate
63 Power outlet plate

70 Gas and electrolyte discharge from anode
72 Gas removal unit for oxygen
74 Gas removal unit for hydrogen and carbon monoxide
90 Electrically conductive connection of anode to anode half shell
91 Electrically conductive connection of GDE 7 and elastic structure 35 to the cathode half shell
Z Electrolysis cell
E Electrolyzer

EXAMPLES

General Description of the Structure of an Electrolysis Cell According to the Invention or of the Electrolyzer Cathode Half Shell The cathode half shell 1 has an electrolyte inlet 13 and an electrolyte outlet 14 and also a gas feed 5 and a gas discharge 6 (see FIG. 1).

The introduction of electrolyte 13 into the cathode half shell 1 is effected from above and the catholyte 17 fed in flows from the top downward along the gas diffusion electrode (GDE) 11. Here, the catholyte 17 flows downward in the gap 12 between the ion exchange membrane 3 and the GDE 11. In order to avoid excessive electrolyte flows through the gap 12, a flow brake 24 is mounted in the gap 12.

The flow brake 24 is made of a porous woven fabric of PTFE as described in WO2003/042430A2.

To ensure that the gap is always supplied with sufficient catholyte 17, the introduction occurs via a distributor channel 34. To ensure that the distributor channel 34 is always filled with catholyte 17, this channel can have an overflow (which is not shown here), via which any excess catholyte 17 fed in can be discharged.

Contacting of the GDE 11 with the power inlet lead 31 in the cathode space is effected via an elastically mounted electrically conductive structure 35. This elastic structure 35 rests on a stiff nickel metal structure in the form of expanded metal (not shown in FIG. 1). The expanded metal is electrically conductively connected by means of a stiff connection 91 to the cathode half shell. The GDE 11 is mounted on the elastic structure 35 and is electrically contacted from the side of the gas space 4. The cathode half shell 1 is in electrical contact either with an anode half shell 2 of another adjacent electrolysis cell Z2 in the case of bipolar connection of a plurality of electrolysis cells Z1 or with the power supply plate 62. The outermost anode half shell 2 is correspondingly electrically connected to the power outlet plate 63.

The gas feed 5 for the introduction of carbon dioxide 33 into the gas space 4 takes place in the lower part of the gas space 4, and the discharge conduit 6 for gaseous reaction products from the cathode space 16 is located in the upper region of the gas space 4. To prevent gas leaving the cathode space 16 together with the electrolyte via the catholyte outlet 14, the outlet 14 is, in one variant, advantageously arranged so that it can be introduced in an immersed manner into the exterior collection tube conduit for catholyte 43. This immersion is known in principle (see, for example, DE102005027735A1).

In an electrolyzer E, the discharge conduits 14 and the feed conduits 13 for the catholyte are joined to a plurality (n) of electrolysis cells Z1, Z2, . . . Z(n) via exterior connection tube conduits—collector 43 or distributor 42—(FIG. 4) in which there is a flow connection. Likewise, the gas discharge conduits 6 and gas feed conduits 5 are joined via exterior connection tube conduits—collector 45 or distributor 44—(FIG. 5). The analogous joining of anolyte feed conduits 8 from the distributor 40 and the joining of anolyte discharge conduits 9 in the collector 41 is depicted in FIG. 3. The gas discharge conduits 7 for the anode gas are collected, which can likewise occur via a collection tube conduit (not shown) and the second gas separation unit 20 (FIG. 3) or the anode gas is discharged from the anode space 15 together with the anolyte via joint conduits 70 and separated in the collector 41*b*, which is configured as gas/liquid separation device, into an electrolyte stream (in conduit 9*a*) and the anode gas (in conduit 41*a*) (FIG. 2). The anode gas is then fed via the conduit 41*a* to the second gas separation unit 20 for separation of oxygen and $CO_2$.

The catholyte which has been combined in the collector 43 through the catholyte outlet 14 is preferably fed via a catholyte outlet 14*a* to a gas removal facility 74 in which the catholyte is freed of residual dissolved or dispersed hydrogen and carbon monoxide (see FIG. 6). These residual gases are discarded or burnt.

An oxygen-free electrolyte is taken off from the gas removal facility 72 via the outlet 9*b* and fed to an electrolysis collection facility 19. From here, the electrolyte can, after adjustment of the concentration by addition of water or a more dilute or concentrated electrolyte solution 18, be distributed to anodes and cathodes. From the electrolyte collection facility 19, the electrolyte is brought to the necessary inflow temperature by means of heat exchangers (not shown) and fed via the distributors 42 and 40 to the electrolysis cells via the conduits 8 and 13 (see FIG. 6).

The anolyte combined in the collector 41 via the outlet 9 is preferably fed via the conduit 9*a* to a gas removal facility 72 in which the anolyte is freed of residual gases such as oxygen. These residual gases are, depending on the amount, discarded or reused.

The anolyte which has been freed of oxygen is fed via conduit 9*b* to an electrolyte collection facility 19.

As gas removal facility 72 or 74, it is possible to employ stripping columns which are known per se.

An electrolysis cell Z having an active electrode area of at least 0.1 $m^2$ is used as a basis for operation. The electrolysis cell Z has a width of at least 10 cm. The height of the electrode is at least 30 cm. The rate of supply of electrolyte to the GDE is typically from 25 $l/(h*m^2)$ to 500 $l/(h*m^2)$. Here, l is the volume of catholyte conveyed in liters, h is hour and $m^2$ is the area of the GDE installed.

The drift speed at which the catholyte 17 flows from the top downward through the gap 12 formed by GDE 11 and separator 3 is typically from 0.2 cm/s to 15 cm/s.

The gap 12 between GDE 11 and separator (ion exchange membrane 3) has a gap width of at least 0.1 mm and is at least 30 cm high and 10 cm wide.

Aqueous solutions of alkali metal hydrogencarbonates or mixtures thereof, e.g. sodium or potassium hydrogencarbonate, as used as catholyte 17. Further salts such as alkali metal sulfates or hydrogensulfates can be added as electrolyte salts. The total concentration of the salts is preferably from 0.1 to 2 mol per l, with electrolytes having a conductivity at 25° C. of greater than 10 S/m being used (S is siemens and m is meter). The measurement of the conductivity can be carried out using commercial conductivity measuring instruments.

The outflow temperature of the catholyte from the cathode half shell 1 via 14 is, in particular, not more than 85° C., preferably not more than 60° C., particularly preferably not more than 45° C. The temperature of the catholyte 17 fed to the cell Z is regulated so that the outflow temperature can be adhered to.

An excess of $CO_2$ 33 is fed via the inlet 5 into the gas space 4 of the cathode half shell 1. Here, the amount of $CO_2$ is preferably a multiple of the stoichiometric amount required according to the electric current which flows. From 0.5% to 800% more $CO_2$ than is stoichiometrically required is added.

To obtain better distribution of the $CO_2$ introduced, a gas distributor system in the form of a flexible tube (not shown here) with holes can be used in the electrolysis cell Z in order to achieve uniform distribution of the $CO_2$ introduced and to transport away the reaction products.

Catholyte Circuit

The catholyte 17 taken from the cathode half shell 1 by the cathode outlet 14 may still contain residues of the gas mixture composed of CO, $H_2$ and excess $CO_2$.

A first separation will, for example, occur in an adequately dimensioned collection tube conduit 43 into which the gas/liquid mixture from the electrolysis Z is fed. The collection tube conduit 43 has at least one liquid outlet 14*a* and a gas discharge channel (not shown). The gas discharge channel is connected to a gas collection conduit 45. The gas collection conduit 45 is connected to the gas outlet 6 of the cathode element 1. The gas collection conduit 45 conveys the gas from all electrolysis cells Z to the gas separation unit 21.

The catholyte 17 from the gas collection conduit 43 is fed, in particular, to a gas removal unit 74 via the conduit 14*a*.

From the electrolyte collection facility 19, the electrolyte is fed back to the electrolysis cell Z. The composition of the electrolyte can be tested beforehand and if necessary supplemented with water and the abovementioned salts so that electrolyte having the same concentration is always fed back into the electrolysis cell Z.

From the electrolyte collection facility 19, the electrolyte is conveyed, for example by means of a pump, via a heat exchanger and the distributor tube conduits 40, 42 back to the electrolysis cell Z.

The further processing of the gas mixture which has been separated off from the exterior collection tube conduit 45, which consists of CO, $H_2$ and excess $CO_2$ from the electrolysis cells Z, is by way of example carried out as follows:

Cooling of the gas mixture in a heat exchanger.

The condensate obtained on cooling can, for example, be returned to the electrolyte circuit.

Removal of the excess or unreacted $CO_2$. This can be carried out by means of a membrane process and/or by means of an amine scrub. In the case of the amine scrub, various ethanolamine/water mixtures or else other amines such as monoethanolamine are used as absorption medium. The removal of $CO_2$ occurs under virtually atmospheric pressure in the scrubbing column. The gas flows through the scrubbing column from the bottom upward, while the amine solution flows in countercurrent and takes up the $CO_2$. The loaded scrubbing solution is regenerated by introduction of heat and can then be reused. The $CO_2$ liberated is fed back to the electrolysis elements. In principle, technology as for $CO_2$ removal from power stations can be employed for the removal of $CO_2$ (S. Schmidt, VGB PowerTech 12/2013).

The $CO_2$ which has been separated off is fed together with the required fresh $CO_2$ to be added back to the electrolysis cell.

The separation of remaining CO and hydrogen is then carried out by membrane processes and/or using a cold box. A cold box is a refrigeration chamber which is known in principle and is operated at low temperatures in order to separate CO from $H_2$. In these processes, a temperature of −180° C. and below is achieved. These refrigeration chambers are used for the separation of synthesis gas and can be tailored commercially for the specific user.

The hydrogen obtained from the cold box is passed to further use.

The carbon monoxide obtained from the cold box is passed to further use, for example for producing phosgene and downstream products for polymer production.

A small proportion of the electrolyte (concerns both anolyte and catholyte) is optionally separated off and discarded in order to avoid accumulation of impurities in the electrolyte circuit.

Gas Diffusion Electrode

As gas diffusion electrode (GDE), particular preference is given to using a silver-based GDE analogous to the electrode described in EP2398101 with the variation presented below for the $CO_2$ to CO reduction. The porosity of the catalytically active layer, calculated from material densities of the raw materials used, is more than 10% but less than 80%.

The GDE here is produced as follows:

3.5 kg of a powder mixture consisting of 5% by weight of PTFE powder, 88% by weight of silver(I) oxide and 7% by weight of silver powder (e.g. type 331 from Ferro) were mixed in an Eirich mixer, model R02, equipped with a star swirler as mixing element, at a speed of rotation of 6000 rpm in such a way that the temperature of the powder mixture did not exceed 55° C. In total, mixing was carried out three times at a mixing time of 50 seconds and three times at a mixing time of 60 seconds. After mixing, the powder mixture was sieved using a sieve having a mesh opening of 1.0 mm. The sieved powder mixture was subsequently applied to an electrically conductive support element. The support element was a wire mesh composed of silver and having a wire thickness of 0.14 mm and a mesh opening of 0.5 mm. Application was carried out with the aid of a 2 mm thick template, with the powder being applied using a sieve having a mesh opening of 1.0 mm. Excess powder which projected above the thickness of the template was removed by means of a scraper. After removal of the template, the support with the applied powder mixture is pressed by means of a roller press at a pressing force of 0.45 kN/cm. The gas diffusion electrode was taken from the roller press. The gas diffusion electrode had a porosity of about 50%.

Separator

The separation of anode and cathode chamber serves to avoid mixing of the electrolytes and to avoid an electrochemical short circuit. In the absence of separators, the gas formed at the anode could be directly reduced further at the cathode, which would give rise to an electrochemical short circuit which reduces the current yield and impairs the economics of the process. Furthermore, the hydrogen and/or carbon monoxide formed at the GDE could form explosive gas mixtures with the anodically formed oxygen. As separators, particular preference is given to using cation exchange membranes such as fumasep F 1075-PK from Fumatech or of the type Nafion N 324 (manufacturer: Chemours Company), in particular Nafion N324. A suitable diaphragm is, for example, the structure Zirfon™ Pearl made up of PTFE and zirconium dioxide (manufacturer: Agfa). For example, a cation exchange membrane Nafion N324 is used.

The electrolysis cell is, in particular, constructed so that the separator rests on the anode structure. The anode is configured with hollow spaces which conduct the gas formed at the anode to the side facing away from the separator. As anode structure, it is possible to use, for example, expanded metal, but other structures known from the prior art can be used.

The pressure at which the separator is pressed onto the anode is, in particular, more than 10 mbar.

Anode Space

The anode half shell 2 of the electrolysis cell Z consists, for example, of an anolyte inlet 8 and an anolyte outlet 9 and a second gas outlet conduit 7 from which the gas formed is discharged and also an anode 10. The anode 10 is electrically conductively connected via the lead 90 to the anode half shell 2 (FIG. 1).

The anolyte 15*a* is fed through the anolyte inlet 8 into the lower section of the anode space 15 and taken off via the anolyte outlet 9 in the top part of the anode space 15. Catholyte 17 and anolyte 15*a* thus flow in countercurrent through the electrolysis cell Z.

The anolyte 15*a* is selected as a function of the anode reaction. In the present case, in which oxygen is evolved at the anode 10, the same electrolyte is used as anolyte 15*a* and as catholyte 17.

The anolyte 15*a* fed into the anode half shell 2 therefore consists, for example, of an aqueous electrolyte which contains alkali metal hydrogen carbonate and to which other inert salts are also added in order to increase the conductivity. Such salts include alkali metal sulfates, alkali metal hydrogensulfates or mixtures thereof. The total concentration of alkali metal ions in the electrolyte solution is, in particular, from 0.01 mol/l to 2 mol/l.

The pH of the anolyte 15*a* fed to the anode half shell is preferably from 4 to 9.

The anolyte 15*a* taken off from the anode half shell 2 preferably has a concentration of alkali metal ions of from 0.01 mol/l to 2 mol/l.

The pressure in the anode half shell is, in particular, set to a value which is from 0 to 500 mbar lower than that in the cathode half shell.

A volume flow of the anolyte 15*a* through the inlet 8 in the range from, in particular, 10 l/(h*m$^2$) to 300 l/(h*m$^2$) is fed to the anode half shell.

The outflow temperature of the electrolyte from the anode half shell is preferably not more than 85° C., preferably not more than 60° C., particularly preferably not more than 45° C. The temperature of the anolyte fed to the cell Z is regulated by means of a heat exchanger so that the outflow temperature can be adhered to.

The mixture of oxygen formed and possibly carbon dioxide and the anolyte taken off from the anode half shell 2 is fed via the conduits 70 firstly to an exterior collection tube conduit 41*b*. The collection tube conduit 41*b* has at least one liquid outlet 9*a* and a gas discharge channel 41*a*.

In the variant with separation discharge of anolyte and reaction gas (FIG. 3), the oxygen formed is conveyed together with the carbon dioxide from the anode half shell 2 via the gas discharge conduit 7, optionally dried and fed into the second gas separation unit 20. The $CO_2$ separated off in the second gas separation unit 20 is fed back into the gas space 4 of the cathode half shell 1 via the conduit 5. The oxygen 52 is collected and passed to a further use.

In the variant with separate discharge of anolyte and reaction gas (FIG. 3), the anolyte 15*a* is conveyed out of the anode half shell 2 via the conduit 9 and fed to a collection tube conduit 41. The anolyte 15*a* is separated from residual oxygen and $CO_2$ gas in the collection tube conduit. The anolyte is then fed via the conduit 9*a* to a gas removal unit 72 for the oxygen to effect residual degassing. The anolyte which has been freed of residual oxygen is fed via a conduit 9*b* into an electrolyte collection facility 19.

The catholyte 17 flowing out of the cathode half shell 2 via the outlet 14 is fed to an exterior collection tube conduit 43 (FIG. 4). Any entrained carbon monoxide or hydrogen is conveyed from the collection tube conduit 43 through a conduit which is not shown to the collection conduit 45 for $CO/H_2$. The catholyte 17 goes through the conduit 14*a* into a gas removal unit 74 for removal of residual $CO/H_2$. The catholyte which has been freed of CO and $H_2$ is fed via the conduit 14*b* to the electrolyte collection facility 19.

From the electrolyte collection facility 19, the combined electrolyte is fed back to the electrolysis cell Z. The composition of the electrolyte is tested beforehand and if necessary supplemented with water and/or the abovementioned salts via the feed conduit 18 so that anolyte 15*a* and catholyte 17 of the same concentration can always be recirculated to the electrolysis cell Z.

From the electrolyte collection facility 19, the electrolyte is taken off by means of a pump and fed via heat exchangers and the connection tube conduits to the anode half shell and via a further heat exchanger to the cathode half shell (not shown).

Connection of the Electrolysis Cells to Form an Electrolyzer

Individual electrolysis cells Z1, Z2 . . . are assembled in a number of at least 10 and not more than 100 elements in a rack. The discharge conduits for the electrolytes of the elements 14; 9 and the feed conduits for the electrolytes 8, 13 and also the gas discharge conduits 7; 70; 6 and gas feed conduits 5 are joined from a plurality of electrolysis cells by means of external collectors or distributors, as has been indicated above.

Electrical Separation

If a plurality of electrolysis cells Z are connected in series in a bipolar manner in an electrolyzer E, the total voltage over the electrolyzer increases with each further electrolysis cell Z and the risk of stray currents increases. Careful electrical separation of the electrolyte streams which are fed into the individual electrolysis cell and discharged from the latter thus has to be carried out. If the total voltage is more than 200 V, electrically insulating tubing or pipes, in particular, are used between the fluidically connected connection tube conduits and the electrolysis cell.

The polymer here is selected, in particular, so that it is chemically resistant and also thermally resistant to the electrolyte used and the reaction gases.

Polymers such as polypropylene, polyethylene or PTFE (polytetrafluoroethylene) can preferably be used.

Example 1 (According to the Invention)

An electrolysis unit consisting of an electrolyzer E with individual electrolysis cells Z, Z1, Z2, . . . Z(n) which are connected to one another in a bipolar manner in an electrolyzer rack (not shown) is employed. The individual electrolysis cells Z have an active electrode area of 2.53 m$^2$. Each individual electrolysis cell Z(n) has an anode half shell 2 made of titanium and also a commercial dimensionally stable anode 10 which is provided with a platinum coating from Umicore, Platinode®, for evolution of oxygen. The cathode half shell consists of nickel. All parts of the cathode half shell 1 which come into contact with catholyte 17 are gilded. All parts which electrically contact the gas diffusion electrode 11 are likewise gilded. A silver-PTFE-based electrode (production as described above) is used as gas diffusion electrode 11. Anode half shell 2 and cathode half shell 1 are separated by an ion exchange membrane 3 of the Nafion 324 type (manufacturer: Chemours).

The voltage across the electrolysis cells is set at the rectifier so that a current of 7590 A flows.

The individual electrolysis cell Z is operated as follows:

A 15% strength by weight potassium hydrogencarbonate solution 15*a* is fed with a mass flow of 400 kg/h and a temperature of 35° C. into the anode half shell 2 via the feed conduit 8. A gas mixture consisting of 2266 g/h of oxygen and 12461 g/h of $CO_2$ is taken from the anode half shell 2 via the discharge conduit 7. Furthermore, an 8.8% strength by weight potassium hydrogencarbonate solution is taken off at 358.9 kg/h with a temperature of 42° C. from the anode half shell 2 via the discharge conduit 9. The gas mixture of oxygen and $CO_2$ is fed to a second gas separation unit 20 which separates the oxygen 52 from the $CO_2$ 33. The $CO_2$ 33 which has been separated off is added to the $CO_2$ volume stream 53 which is fed via the feed conduit 5 into the gas space 4 of the cathode half shell 1.

A 15% strength by weight potassium hydrogencarbonate solution 17 is fed at a mass flow of 600 kg/h and a temperature of 30° C. into the cathode half shell 1 via the feed conduit 13. The temperature of the solution flowing out of the cathode half shell 1 via the discharge conduit 14 is 45.3° C. and the solution has a content of potassium hydrogencarbonate of 18.5% by weight. The outflowing mass flow is 640.1 kg/h.

The anolyte 15*a* flowing out of the anode half shell 2 is fed to an exterior collection tube conduit 41. From the exterior collection tube conduit 41, the anolyte 15*a* is fed to a gas removal facility 72 for removal of residual amounts of oxygen. The gas removal unit 72 consists of a stripping column (not shown) having a diameter of 50 cm and a height of 200 cm. Nitrogen flows at a volume flow of 100 l/h in countercurrent to the catholyte introduced from above through a distributor nozzle. $O_2$-free electrolyte can be taken off from the stripping column and fed to the electrolyte collection facility 19.

The catholyte 17 flowing out from the cathode half shell 1 via the conduit 14 is fed to an exterior collection tube conduit 43. The catholyte 17 is connected via the conduit 14*a* to a gas removal unit 74. The gas removal unit 74 consists of a stripping column (not shown) having a diameter of 50 cm and a height of 200 cm. Nitrogen flows at a volume flow of 100 l/h in countercurrent to the catholyte introduced from above via a distributor nozzle. Catholyte 17 which is free of CO and $H_2$ is taken off from the stripping column and fed via the conduit 14*b* to the electrolyte collection facility 19. The gases which have been stripped out are fed to an incineration unit.

A mass flow of 36511 g/h of $CO_2$ is fed via the gas feed conduit 5 into the gas space 4 of the cathode half shell 1. The amount corresponds to about 5.8 times the stoichiometrically required amount of $CO_2$. The temperature is 25° C. The $CO_2$ is saturated with water at 25° C. This is effected by injection of water into the feed conduit 5. The gas velocity of the $CO_2$ in the gas space is about 0.06 m/s at 25° C. The proportion of water vapor in the gas was not taken into account in the calculation.

The reaction gas mixture is fed via the discharge conduit 6 of a gas collection conduit 45 into the gas space 4. The gas from the gas collection conduit 45 is fed to a gas separation unit 21 for separation of CO, $H_2$ and excess or unreacted $CO_2$ (FIG. 5). The gas mixture has the following composition: carbon monoxide: 2577 g/h, hydrogen 99 g/h, $CO_2$ 20000 g/h. In a first part of the gas separation unit 21, the $CO_2$ 33 which has been separated off is fed into a gas recirculation conduit 53 and recirculated via a gas distributor conduit 44 of the gas feed conduit 5 to the cathode half shell 1. A substream of the $CO/H_2$ mixture from the first stage of the gas separation in the gas separation unit 21 is passed to the chemical synthesis of methanol (not shown). The remaining $CO/H_2$ mixture is fed to the second stage of the gas separation unit 21 which separates hydrogen and CO. The separated gases are passed to further chemical syntheses; in particular, the CO is supplied to a process for producing isocyanate in which phosgene is produced from CO and chlorine in a first step and the resulting phosgene is processed further to give isocyanates.

It has thus been able to be shown that $CO_2$ can be converted into CO in an industrial electrolyzer and, especially, a sustainable production process for producing required industrial amounts of CO has been made possible.

The invention claimed is:

1. An electrolysis cell for an electrochemical reaction of $CO_2$ on an industrial scale of more than 0.1 kg $CO_2/(h*m^2)$, comprising:

at least a cathode half shell having a rear wall;

a gas space comprising carbon dioxide gas;

a cathode with a vertical main extension of at least 30 cm:

an anode half shell;

a separator arranged between the anode half shell and the cathode half shell for separating anode space and cathode space; and electric power leads;

wherein a distance from the cathode to the rear wall of the cathode half shell is not more than 5 cm to achieve a velocity of the carbon dioxide gas in the gas space close to a rear side of the cathode from 0.001 to 15 m/s, wherein the gas space is connected to a first gas feed conduit for carbon dioxide gas and to a first gas discharge conduit for gaseous reaction products, and having a catholyte, a catholyte inlet and a catholyte outlet, wherein the anode half shell is provided with at least a second gas discharge conduit for an anode reaction product, an anolyte inlet, anolyte and an anolyte outlet and an anode, wherein the electric power leads are for connecting the anode and the cathode to a DC voltage source, wherein the cathode is configured as a gas diffusion electrode for reacting carbon dioxide gas and the cathode, and wherein the anode and the separator are arranged vertically in their main extension and a gap for passage of the catholyte according to the principle of a falling liquid film is arranged between the separator and the cathode.

2. The electrolysis cell as claimed in claim 1, wherein the separator is an ion exchange membrane or a diaphragm.

3. The electrolysis cell as claimed in claim 1, wherein the cathode is configured as gas diffusion electrode based on silver and/or silver oxide, as electrocatalyst and having a pulverulent fluoropolymer, in particular PTFE powder, as nonconductive binder compacted on a metallic or nonmetallic, conductive or nonconductive support.

4. The electrolysis cell as claimed in claim 1, wherein the first gas discharge conduit is connected to an upper end of the gas space and the second gas discharge conduit is connected to an upper end of the anode space and the first gas feed conduit is connected to a lower end of the gas space.

5. The electrolysis cell as claimed in claim 1, wherein the catholyte is an aqueous solution of alkali metal hydrogencarbonate.

6. The electrolysis cell as claimed in claim 1, wherein the anolyte is an aqueous solution of alkali metal hydrogencarbonate.

7. The electrolysis cell as claimed in claim 1, wherein when the same electrolyte salt is used for anolyte and catholyte, the catholyte outlet is located at a lower end of the gap and the catholyte inlet is located above the gap on the cathode half shell and the catholyte outlet is connected via a collection tube conduit to an electrolyte collection facility in which catholyte from the catholyte outlet and anolyte from the anolyte outlet are combined.

8. The electrolysis cell as claimed in claim 1, wherein the first gas discharge conduit is connected, to a gas separation unit for separating carbon monoxide, hydrogen and unreacted carbon dioxide gas.

9. The electrolysis cell as claimed in claim 8, wherein the gas separation unit has a recirculation conduit for carbon dioxide gas which has been separated off, which recirculation conduit is connected via a distributor tube conduit to the first gas feed conduit for carbon dioxide gas.

10. The electrolysis cell as claimed in claim 8, wherein the gas separation unit has a discharge conduit for carbon monoxide which has been separated off, which discharge conduit is connected to a chemical production plant for chemical reaction of carbon monoxide.

11. The electrolysis cell as claimed in claim 8, wherein the gas separation unit has a discharge conduit for hydrogen which has been separated off, which discharge conduit is connected to a hydrogen pipe network or a dispensing plant for hydrogen.

12. The electrolysis cell as claimed in claim 1, wherein a means for slowing a flow of a catholyte stream is provided in the gap.

13. The electrolysis cell as claimed in claim 12, wherein the means for slowing the flow is configured as electrically nonconductive, inert sheet-like textile structure.

14. The electrolysis cell as claimed in claim 1, wherein the second gas discharge conduit for the anode reaction product and the anolyte outlet form a unit and are connected to a collection tube conduit in which a gas/liquid separation occurs and is connected, optionally via a gas removal unit, by an anolyte recirculation conduit, optionally via an electrolyte collection facility, to the anolyte inlet.

15. The electrolysis cell as claimed in claim 1, wherein a electrolyte recirculation conduit has a feed conduit and mixing unit for mixing in either water or more highly concentrated electrolyte.

16. The electrolysis cell as claimed in claim 1, wherein the anode rests on the separator with point-, line- or area-shaped contact positions of the anode.

17. An electrolyzer for the electrochemical reaction of $CO_2$ on an industrial scale by a membrane electrolysis process or diaphragm electrolysis process, wherein the electrolyzer has a plurality of electrolysis cells as claimed in claim 1, which cells are electrically connected to one another in a bipolar manner.

18. The electrolysis cell as claimed in claim 1, wherein the vertical main extension of the cathode is at least 100 cm.

* * * * *